United States Patent [19]

Duhem

[11] 4,146,975

[45] Apr. 3, 1979

[54] ROTATING HEAT EXCHANGER

[75] Inventor: Victor Duhem, Avon, France

[73] Assignee: Fives-Cail Babcock, Paris, France

[21] Appl. No.: 803,578

[22] Filed: Jun. 6, 1977

[51] Int. Cl.[2] ..... F26B 11/04

[52] U.S. Cl. ..... 34/134; 34/137; 432/106; 432/107

[58] Field of Search ..... 34/63, 66, 68, 135, 34/134, 136, 137; 432/106, 111

[56] References Cited

U.S. PATENT DOCUMENTS

| | | | |
|---|---|---|---|
| 1,813,061 | 7/1931 | Lindhard | 34/63 |
| 1,823,189 | 9/1931 | Carpenter | 34/134 |
| 2,019,179 | 10/1935 | Fasting | 34/63 |
| 2,552,835 | 5/1951 | Arnold | 34/134 |

FOREIGN PATENT DOCUMENTS 2123585 4/1972 France.

*Primary Examiner*—John J. Camby
*Assistant Examiner*—Larry I. Schwartz
*Attorney, Agent, or Firm*—Kurt Kelman

[57] ABSTRACT

In a rotary heat exchanger, two groups of tubes are concentrically arranged about a drive shaft and the tubes have ports at their ends which are in communication with inlet and discharge chambers to which respective streams of gas are delivered so that two separate streams of gas may be circulated through the tubes. A solid granular material is supplied into the tubes of one group at one end and, near the other end, the tubes of the first and second groups are interconnected for passing the material from one group to the other.

10 Claims, 3 Drawing Figures

ROTATING HEAT EXCHANGER

The present invention relates to a rotating heat exchanger comprising an axle of rotation and first and second groups of tubes arranged about the axle of rotation, the tubes of the first and second groups having axes parallel to the axis of the axle of rotation.

A heat exchanger of this type arranged to subject solid granular materials to two consecutive treatments by means of two separate streams of gas is known from French patent publication No. 2,123,585. It comprises two groups of tubes arranged in alignment and joined together to permit passage of the solid materials from the tubes of one group to those of the other group, the treating gases being introduced and discharged at the junction between the two groups. The junction is constituted by tubes joining the adjacent ends of the tubes of the first and second groups and placed thereabout. All the tubes are welded together and the welding seams are subject to great wear because they are located in the zone where the flexing moment is at a maximum. Some of these welds must be effected at the assembly site because the apparatus is too voluminous to be transported in assembled condition, which presents added difficulties. Additionally, this apparatus in quite long.

In my U.S. Pat. No. 3,571,944, I have disclosed a rotating heat exchanger arranged to subject a product to a single treatment by a stream of gas, which comprises a plurality of elongate contiguous independent conduits each having an inlet and a discharge end, the conduits being fixed together to form a self-supporting bundle, means to rotate the bundle, the bundle comprising a central conduit surrounded by an intermediate group of conduits concentrically disposed about the central conduit, a peripheral group of conduits disposed concentrically about the intermediate group of conduits, the central conduit inlet end being arranged to receive a product, means connecting the central conduit discharge end into the respective inlet ends of the conduits of the intermediate group, means connecting the discharge ends of the conduits of the intermediate group to the inlet ends of the conduits of the peripheral group, and the discharge ends of the conduits of the peripheral group leading into a discharge chamber of the bundle, whereby a product fed into the central conduit successively passes through the central, intermediate and peripheral conduits, thereby making three passes through the bundle, reversing direction twice, before entering the discharge chamber. The product and gas take the same path on the heat exchanger.

It is the primary object of this invention to overcome the disadvantages of the prior art and to provide a rotating heat exchanger for subjecting a solid granular material to two consecutive treatments by two distinct gaseous streams while keeping the length of the heat exchanger to about half that of conventional heat exchangers capable of such consecutive heat treatments, such as drying and cooling, for example.

It is another object of the invention to provide a heat exchanger of this type wherein the junctions between the heat exchange tubes and their supports are positioned near the ends of the heat exchanger in zones where the flexing moments are relatively small.

The above and other objects are accomplished in accordance with the present invention with a rotating heat exchanger which comprises an axle of rotation, a first group of tubes arranged about the axle of rotation, and a second group of tubes arranged about the first group of tubes, the tubes of the first and second groups haves axes parallel to the axle of rotation, and each of the tubes having ports at respective ends thereof. Respective gas inlet and discharge chambers are in communication with the ports at respective ends of the heat exchanger. A first stream of gas is circulated between the chambers through the tubes of the first group, and a second stream of gas is circulated between the chamber through the tubes of the second group. Means at one of the ends supplies a solid granular material into the tubes of one of the groups, and channel means near the other end connects the tubes of the first and second groups for passing the solid material from the one to the other group of tubes.

The streams of gas may circulate concurrently with, or countercurrently to, the solid granular material. In one particular embodiment, the two streams of gas enter the tubes at the feed and discharge end of the solid material, and are collected at the other end in the same chamber.

The above and other objects, advantages and features of this invention will become more apparent from the following detailed description of a now preferred embodiment thereof, taken in conjunction with the accompanying drawing wherein FIG. 1 is a longitudinal section of the heat exchanger, along line I—I of FIG. 2;

Figure 1:
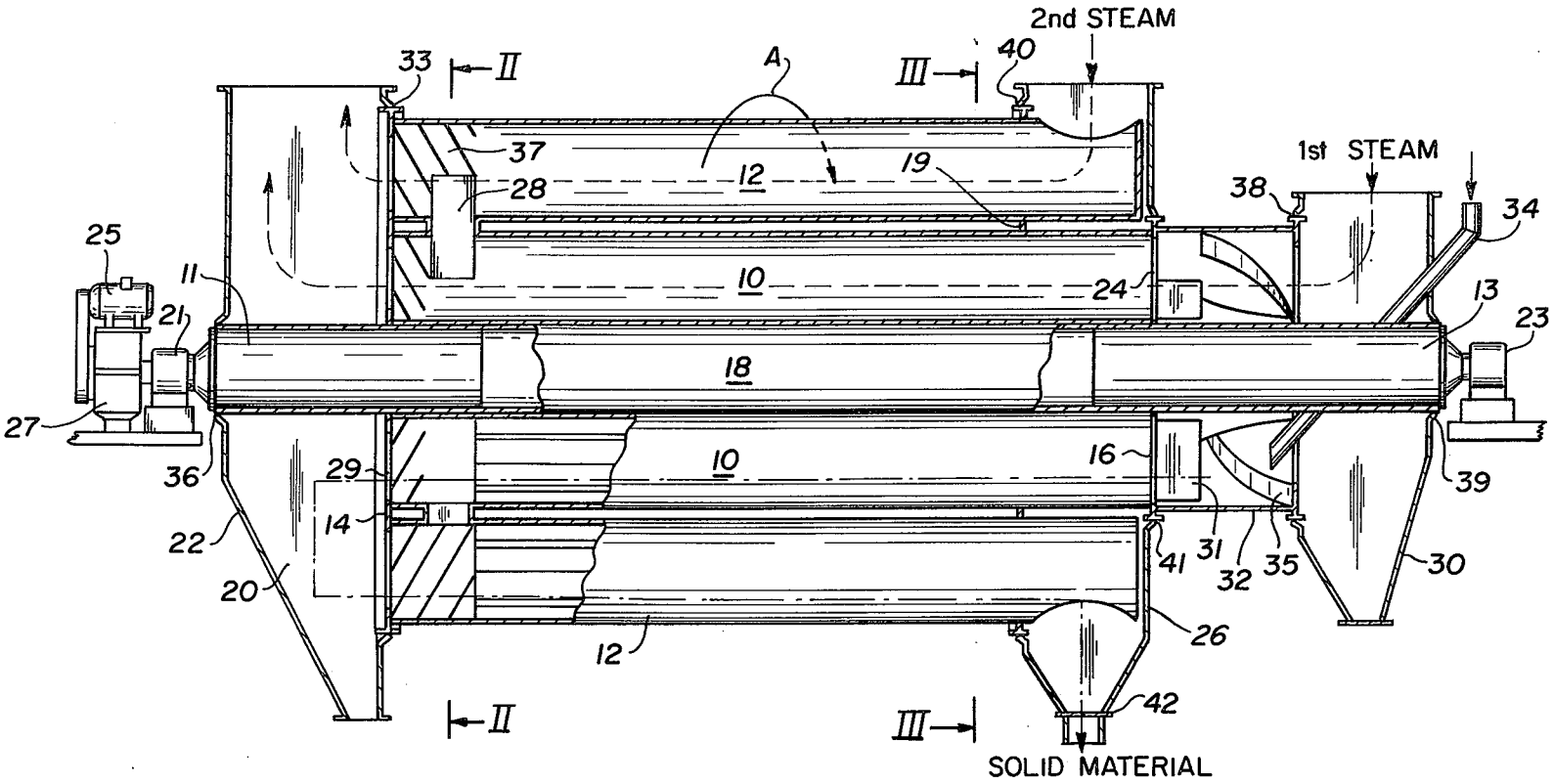

Referring now to the drawing, there is shown a heat exchanger comprising central tube 18, a first group of tubes 10 arranged about the central tube and a second group of tubes 12 arranged about the first group of tubes. The axes of the tubes are parallel to each other, the two groups of tubes being arranged concentrally about the central tube and the axes of the first and second groups of tubes defining respective cylinders which are coaxial with the axis of the central tube.

The central tube is an axle of rotation arranged to carry and drive the groups of tubes 10 and 12, a support plate 14 and 16 being affixed to axle of rotation 18 at each end of tubes 10 of the first group and the ends of the tubes of the first group being affixed to support plates 14 and 16. The axle of rotation has stub shafts 11 and 13 extending from respective ends of tube 18 and these stub shafts are journaled in bearing boxes 21 and 23 to enable the heat exchanger to rotate. The axle of rotation is driven by motor 25 which is coupled to stub shaft 11 by gear box 27.

One of the ends of tubes 12 of the second group is also affixed to support plate 14 while the other ends thereof are supported by intermediate support plate 19 affixed to tubes 10 of the first group. Support plate 19 has openings wherein tubes 12 are glidably mounted, the components of the assembly 18, 10, 12, 14, 16 and 19 forming a rotary unit whose axle of rotation is horizontal or slightly inclined to facilitate movement of solid material from one end towards the other.

Figure 3:
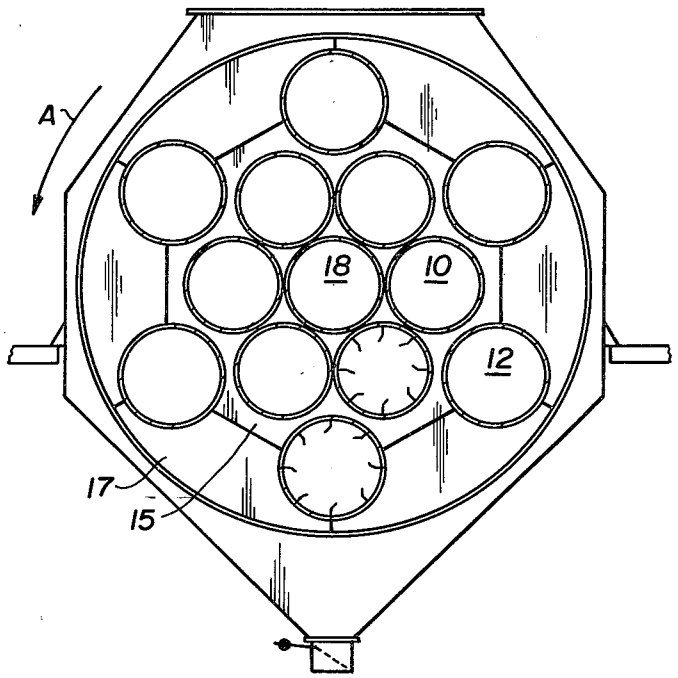
FIG. 3 is another transverse section along line III—III of FIG. 1.
Figure 2:
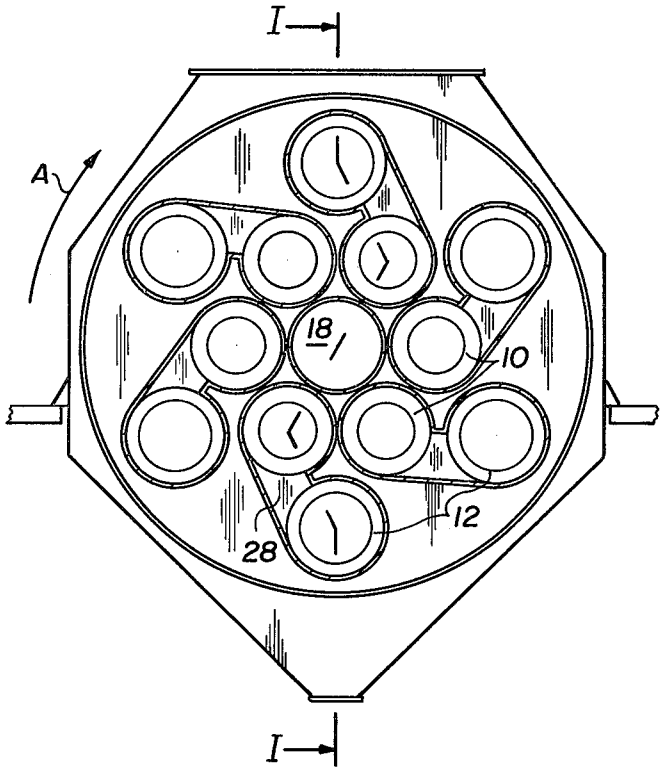
FIG. 2 is a transverse section along line II—II of FIG. 1.

As may best be seen in FIG. 3 in connection with support plate 19, at least one of the support plates in the illustrated embodiment is constituted by sheet metal disc 15 having a radius smaller than that of a cylindrical envelope generated by the rotation of tubes 12 of the second group and sheet metal elements 17 affixed to the periphery of the discs. In the illustrated embodiment, disc 15 is hexagonal and the radius of the circle circumscribed about the hexagon is approximately equal to the distance between the axes of tubes 12 and of axle of rotation 18. If desired, the disc may actually be circular. Sheet metal elements 17 are affixed to the sides of the hexagon by assembly on site. The structure of support plate 14 is identical to that of plate 19. The construction will reduce the weight and make the apparatus less cumbersome in transport.

As can be seen in FIG. 1, the ports of tubes 10 and 12 of the first and second groups communicate through ports 29 in support plate 14 with discharge chamber 20 defined between support plate 14 and hood 22 adjacent thereto. Fluid-tight friction joints 33 and 36 are mounted on stationary hood 22 and bear, respectively, on the periphery of support plate 14 and stub shaft 11.

At the same end of the heat exchanger, channel or conduit means 28 connect each tube 10 to a respective tube 12 for passing solid granular material from the tubes of the first group into the tubes of the second group. These channels or conduits are spaced from the end of the tubes to prevent the granular material from passing out of the tubes and into gas discharge chamber 20 as the material is transferred between the tubes. Helical channels 37 in the interior of the tubes between support plate 14 and conduits 28 guide the granular material from this zone towards the conduits. If desired, a single tube 10 could be connected to several tubes 12 or several tubes 10 could be connected to a single tube 12.

At their other ends, the ports of tubes 10 communicate with the interior of cylindrical sleeve 32 through ports 24 in support plate 16, the sleeve being arranged coaxial with axle of rotation 18 and for rotation with tubes 10 of the one group by affixing sleeve 32 to support plate 16. Means is mounted at this end of the heat exchanger for supplying a granular solid material into tubes 10, the illustrated supply means comprising delivery conduit 34 leading into sleeve 32, helical channels 35 in the interior wall of the sleeve for guiding the supplied material from conduit 34 towards the tubes and baffles 31 fixed to support plate 16 for guiding the material from helical channels 35 through ports 24 into the interior of tubes 10 (see chain-dotted lines in FIG. 1, indicating the path of the solid material).

The outer end of sleeve 32 is closed by hood 30 defining with support plate 16 a gas inlet chamber. Fluid-tight friction joints 38 and 39 are mounted on stationary hood 30 and bear, respectively, on the periphery of sleeve 32 and stub shaft 13.

The ends of tubes 12 of the second group opposite to the tube ends affixed to support plate 14 pass freely through openings in intermediate support plate 19 and open into a material discharge chamber defined by support plate 19 and adjacent hood 26. Fluid-tight friction joints 40 and 41 are mounted on stationary hood 26 and bear, respectively, on peripheries of support plates 19 and 16.

Helical entrainment elements may be mounted in the interior of tubes 10 and 12 for advancing the solid granular material from its feed end towards conduits 28 and from the conduits to the material discharge chamber whence the treated material may be removed through screen 42 (see chain-dotted lines in FIG. 1).

To reduce heat exchange through the walls of the tubes between tubes 10 of the first group and tubes 12 of the second group, the two groups are spaced from each other in operations wherein the temperature of the gas circulating through one group of tubes differs substantially from that of the gas circulating through the other group of tubes. For instance, a hot gas may be circulated through tubes 10 to dry the granular material supplied to the heat exchanger while a cold gas is circulated through tubes 12 to cool the dried material. The radial gap between the two groups of tubes prevents the hot gas from being unduly cooled by the cold gas and the cold gas from being unduly warmed by the hot gas.

The operation of the apparatus will be obvious from the above description of its structure and will be further elucidated hereinbelow.

Solid granular material to be treated is introduced through supply conduit 34 and passed by helical channels 35 in the interior wall of sleeve 32 and baffles 31 into revolving tubes 10 wherein they are displaced to the other end by helical channels in the interior walls of the tubes until they reach conduits 28 which transfer the material into revolving tubes 12 wherein they are displaced back by helical channels in the interior walls of the tubes until they reach the material discharge chamber defined by hood 26. The treated material is discharged by gravity through screen 42.

In the first group of tubes 10, the material is treated during its passage through the tubes by a first stream of gas which is introduced into the gas inlet chamber defined by hood 30 and circulates through tubes 10 concurrently with the material, the spent gas being collected in gas discharge chamber 20 at the other end whence it is evacuated by a flue. (see broken line indicating first stream in FIG. 1). In the second group of tubes 12, the material coming through conduits 28 from tubes 10 is subjected to treatment by a second and distinct stream of gas introduced through hood 26 and flowing through tubes 12 countercurrently to the flow of the material therethrough, the gas from the second stream also being collected in and evacuated from, discharge chamber 20 (see broken line indicating second stream in FIG. 1).

If desired, gas discharge chamber 20 may be divided into two compartments, the gases from the first stream coming from tubes 10 being collected in, and evacuated from, one of the compartments while the gases from the second stream flow from tubes 12 into the other compartment of gas discharge chamber 20 and are separately evacuated therefrom. In this embodiment, it is also possible to reverse the direction of the gas flow in tubes 10 and/or in tubes 12.

In all cases, steps must be taken to assure that the gas pressures in tubes 10 and 12 at connecting conduits 28 are substantially the same to avoid passage of gas between the tubes, i.e. to make certain that the two streams of gas are kept distinct and separate.

While the rotary heat exchanger has been illustrated as being supported at both ends by bearings, it could be supported by a bearing at one end while the other end rests on rollers, an annular race being provided on sleeve 32 or on axle of rotation 18 for engagement by the rollers. Obviously, both ends of the heat exchanger could be so supported.

The heat exchanger may be used in all instances where a product is to be subjected to two successive treatments, such as drying followed by cooling, i.e. consecutive treatments by hot and cold gases. Thus, it will find use in the manufacture of fertilizer, foundry sand, and agricultural and food products, such as sugar, for example.

What is claimed is:

1. A rotating heat exchanger comprising a. an axle of rotation,
b. a first group of tubes arranged about the axle of rotation,
c. a second group of tubes arranged about the first group of tubes,
   1. the tubes of the first and second groups having axes parallel to the axle of rotation and
   2. each of the tubes having ports at respective ends thereof, the ports of the tubes of the first and second groups of tubes at each of the ends being substantially coplanar,
d. respective gas inlet and discharge chambers in communication with the ports at respective ends of the heat exchanger,
e. means for circulating a first stream of gas between the chambers through the tubes of the first group,
f. means for circulating a second and separate stream of gas between the chambers through the tubes of the second group,
g. means at one of the ends for supplying a solid granular material into the tubes of one of the groups,
h. channel means near the other end for connecting the tubes of the first and second groups for passing the solid granular material from the one to the second group of tubes, and
i. outlet means at the one end for removing the solid granular material from the second group of tubes.

2. The rotating heat exchanger of claim 1, wherein the axle of rotation is arranged to carry and drive the groups of tubes, and further comprising a support plate at each end of the tubes of the first group, the support plates being affixed to the axle of rotation and the ends of the tubes of the first group being affixed to the support plates.

3. The rotating heat exchanger of claim 2, further comprising a stationary hood adjacent each of the two support plates, the inlet and discharge chambers being defined between the support plates and hoods, and fluid-tight joints between the supports plates and the hoods.

4. The rotating head exchanger of claim 2, wherein one of the ends of the tubes of the second group is affixed to one of the support plates, and further comprising another support plate intermediate the end support plates, the other ends of the tubes of the second group being supported by the intermediate support plate.

5. The rotating heat exchanger of claim 4, wherein at least one of the support plates is constituted by a sheet metal disc having a radius smaller than that of a cylindrical envelope generated by the rotation of the tubes of the second group and sheet metal elements affixed to the periphery of the discs.

6. The rotating heat exchanger of claim 1, wherein the ports of the tubes of the first and second groups communicate with the same one of the chambers at the other end.

7. The rotating heat exchanger of claim 6, further comprising a cylindrical sleeve at the one end, the sleeve being arranged for rotation with the tubes of the one group, and the means for supplying a solid granular material comprises a delivery conduit leading into the sleeve and baffles arranged in the interior of the sleeve for introducing the material from the sleeve into the tubes of the one group.

8. The rotating heat exchanger of claim 7, further comprising another stationary hood at the one end, the other hood defining a material discharge chamber and the tubes of the other group being in communication with the material discharge chamber for delivering treated material thereto.

9. The rotating heat exchanger of claim 1, wherein a radial gap is defined between the first and second groups of tubes.

10. The rotating heat exchanger of claim 1, further comprising means within the tubes between the other end and the channel means for guiding and entraining the solid granular material towards the channel means.

* * * * *